US005396959A

United States Patent [19]

Macdonald

[11] Patent Number: 5,396,959

[45] Date of Patent: Mar. 14, 1995

[54] SPRINKLER SYSTEM

[75] Inventor: Norman Macdonald, Boxboro, Mass.

[73] Assignee: PNM, Inc., Boxborough, Mass.

[21] Appl. No.: 123,110

[22] Filed: Sep. 20, 1993

[51] Int. Cl.[6] ..... A62C 35/68

[52] U.S. Cl. ..... 169/51; 169/16; 52/39; 52/506.06; 239/209

[58] Field of Search ..... 169/51, 5, 16, 17, 18, 169/37; 239/200, 208, 209; 52/39, 506.06, 506.07; 248/342, 343, 344

[56] References Cited

U.S. PATENT DOCUMENTS

| | | | |
|---|---|---|---|
| 2,017,841 | 10/1935 | Coleman | 169/16 X |
| 2,297,808 | 10/1942 | Soucy | 169/61 |
| 2,890,758 | 6/1959 | Pfalzgraff et al. | 169/37 |
| 2,988,150 | 6/1961 | Smith | 169/56 |
| 3,388,747 | 6/1968 | Hodnett | 169/39 |
| 3,763,936 | 10/1973 | Menage | 169/45 |
| 3,871,458 | 4/1975 | Dumazet | 169/45 |
| 3,892,277 | 7/1975 | Curran | 169/16 |
| 4,785,887 | 11/1988 | Miller | 169/37 |
| 4,791,993 | 12/1988 | Curran | 169/16 |
| 4,964,470 | 10/1990 | Gaulin | 169/56 |
| 5,327,976 | 7/1994 | Hattori | 169/16 X |

*Primary Examiner*—David M. Mitchell
*Assistant Examiner*—Andrew C. Pike
*Attorney, Agent, or Firm*—Morse, Altman, Dacey & Benson

[57] ABSTRACT

A sprinkler system, for cooperation with an array of ceiling tiles, essentially features a mount of tiles including at least one with a central opening, a web disposed above the mount of tiles and including a central hub and legs extending therefrom to the corners of a frame with a dimensional profile like that of the tiles, a number of ceiling wires supporting the frame in spaced relation to a ceiling, a sprinkler head supported within the central hub and extending through the central opening, and apparatus for connecting the sprinkler head to a source of fluid. Preferably, the apparatus includes a rigid stationary water grid and supply and a flexible hose connecting the sprinkler head to the water grid and supply. Preferably, the flexible hose is an annealed stainless steel braid hose having an open pitch.

12 Claims, 4 Drawing Sheets

SPRINKLER SYSTEM

BACKGROUND OF THE INVENTION

1. Field of the Invention

The present invention relates generally to sprinkler systems and, more particularly, to a sprinkler system designed for cooperation with an array of ceiling tiles supported on a grid of rails.

2. The Prior art

Sprinkler system are in wide use today in office buildings, factories and including some homes. In 1941, Ernest Soucy of Rumford, Me., developed a sprinkler system for chimneys, see U.S. Pat. No. 2,297,808. Soon thereafter, protection caps for automatic sprinkler heads were introduced, designed to protect the temperature sensitive elements associated with sprinkler heads against chemical corrosion and mechanical stress, see U.S. Pat. No. 2,890,758. A more sophisticated protection cap for automatic sprinkler heads is disclosed in U.S. Pat. No. 3,388,747 that issued to R. M. Hodnett in 1968. And an improved sprinkler connection to a scrubber duct carrying noxious and inflammable gases has been disclosed in a recently issued U.S. Pat. No. 4,964,470 to Gaulin.

The art is thus both old and extensive. Yet there is still plenty of room for improvements.

SUMMARY OF THE INVENTION

It is a principal object of the present invention to overcome any disadvantages of the prior art by providing an improved adjustable sprinkler system designed for use in cooperation with an array of ceiling tiles of generally like dimensional profile and having connection to a rigid stationary water grid and supply via a flexible hose.

More specifically, it is an object of the present invention to provide an improved adjustable sprinkler system for cooperation with an array of ceiling tiles of generally like dimensional profile, which sprinkler system essentially comprises a mount of ceiling tiles of like dimensional profile, with at least one having a central opening, and a web disposed above the tile mount and including a central hub and legs extending from the hubs to the corners of a frame with a dimensional profile like that of the ceiling tiles. A number of ceiling wires support the frame in spaced relation to a ceiling. A sprinkler head is supported within the central hub of the web and extends therethrough and means are provided for connecting the sprinkler head to a source of fluid. Preferably, the means includes a rigid stationary water grid and supply and a flexible hose connecting the sprinkler head to the rigid stationary water grid and supply. Preferably, the flexible hose comprises an annealed stainless steel braid hose having an open pitch. Preferably, the flexible hose comes with lengths variable from about 24 inches to about 48 inches and with diameters variable from about ½ inch to about 1 ½ inches. The sprinkler system can comprise one or more sprinkler heads, each connected via its own flexible hose to the rigid stationary water grid and supply.

Other objects of the present invention will in part be obvious and will in part appear hereinafter.

The invention accordingly comprises the improved sprinkler system of the present disclosure, its components, parts, and their interrelationship, the scope of which will be indicated in the appended claims.

BRIEF DESCRIPTION OF THE DRAWINGS

For a fuller understanding of the nature and objects of the present invention, reference is to be made to the following detailed description, which is to be taken in connection with the accompanying drawings, wherein.

DETAILED DESCRIPTION OF THE PREFERRED EMBODIMENT

In general, the sprinkler system of the invention is designed for use in office buildings, hospitals, warehouses, private homes, and the like whose ceilings employ an array of ceiling tiles mounted in spaced relation to a ceiling.

Figure 1:
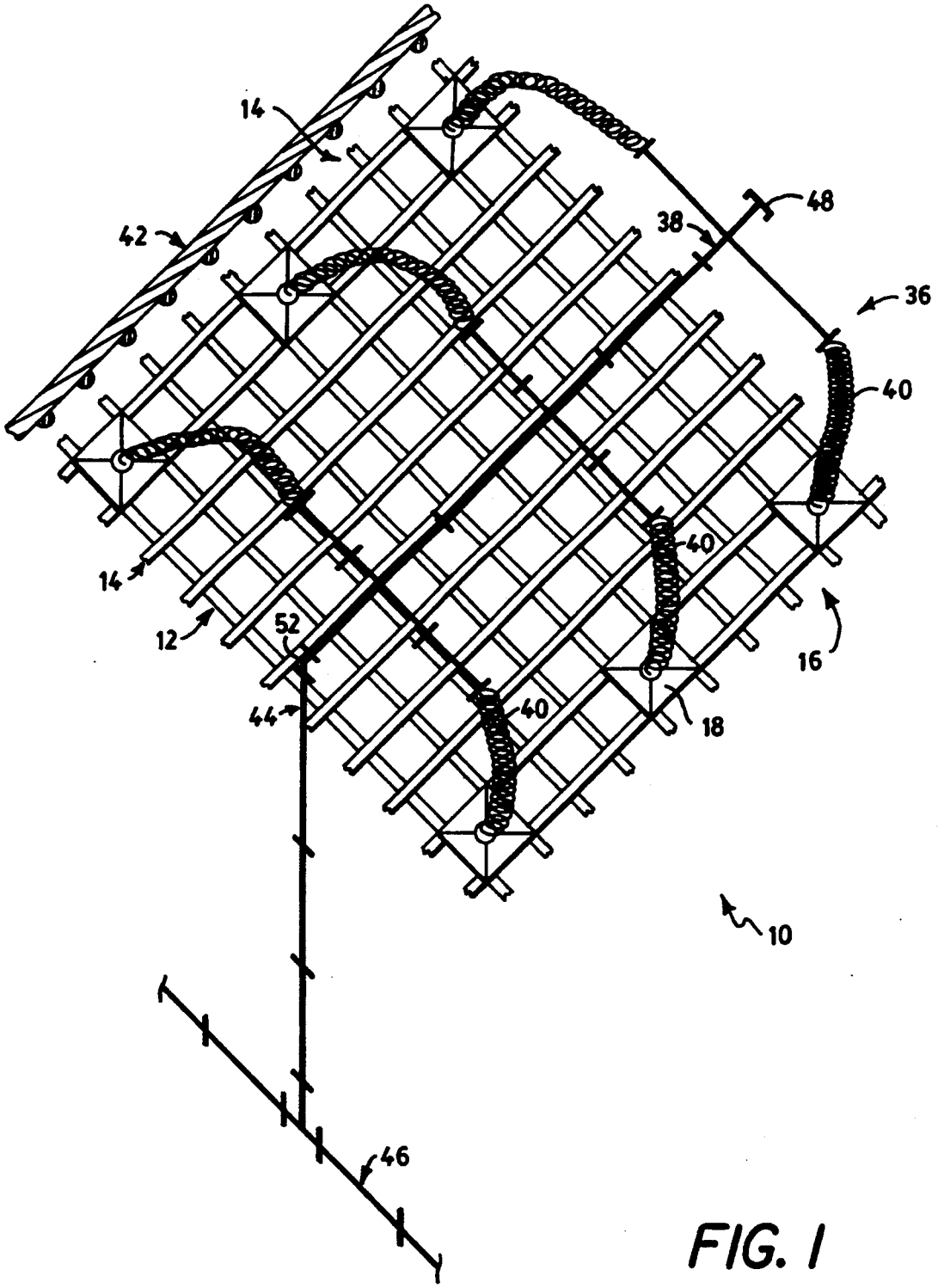
FIG. 1 is a schematic plan view of a sprinkler system constructed in accordance with the present invention.
Figure 2:
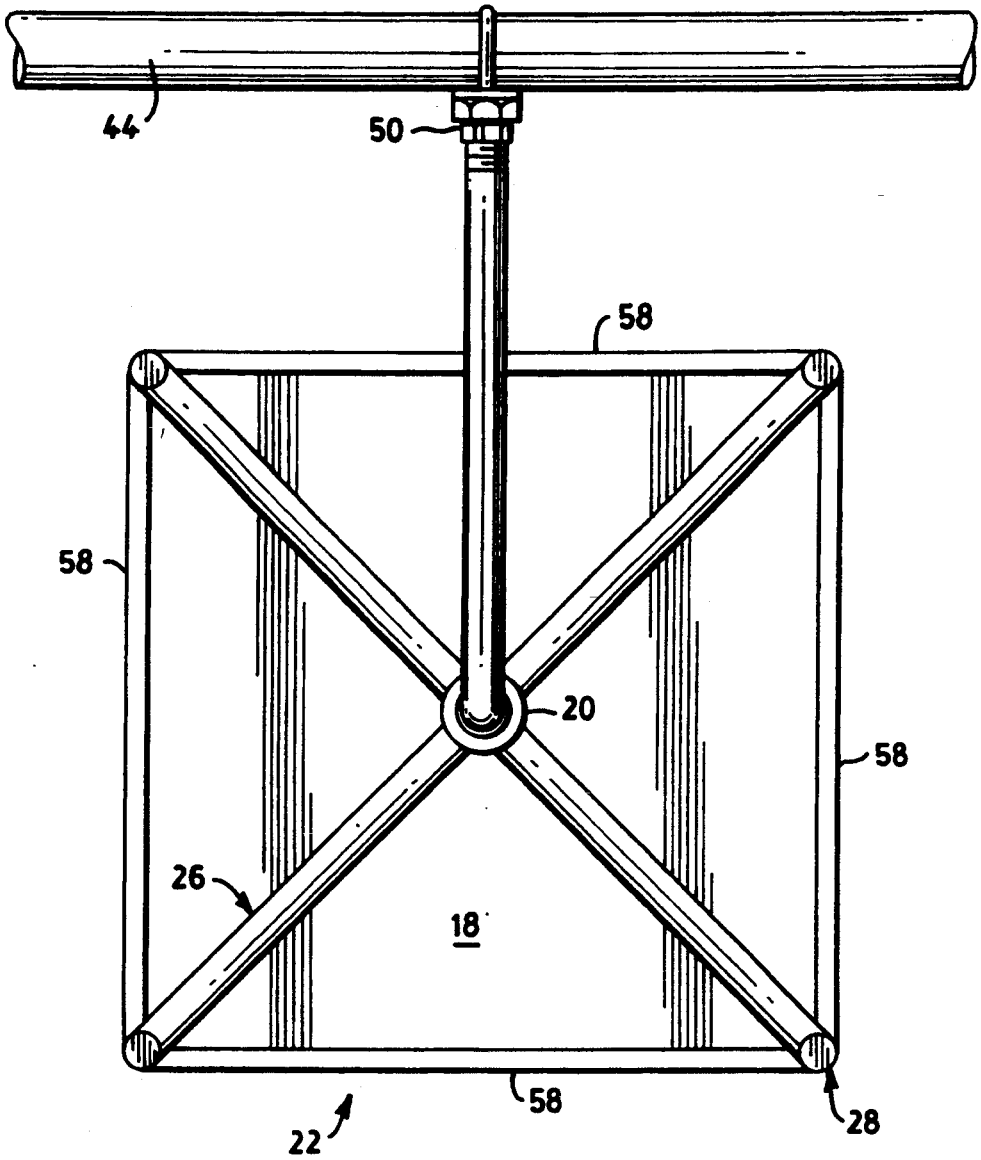
FIG. 2 is a schematic view of a portion of the sprinkler system of FIG. 1 but on an enlarged scale.

A schematic plan view of a sprinkler system 10 constructed in accordance with and embodying the present invention is illustrated in FIG. 1. The sprinkler system 10 is designed for use in cooperation with an array of ceiling tiles 12 supported on a grid of rails 14, with the tiles 12 being generally of like dimensional profile.

Essentially, the sprinkler system 10 comprises a mount 16 of tiles, including at least one tile 18 provided with a central opening 20. A web 22, disposed above the array of ceiling tiles 12, includes a central hub 24 and legs 26 extending from the hub 20 to the corners of a frame 28. The frame 28 is of like dimensional profile and supports one tile 18. A plurality of ceiling wires 30, connected to the corners of the frame 28, support the frame 28 in spaced relation to a ceiling 32. A sprinkler head 34, supported within the central hub 24, extends through the central opening 20. Means 36, mounted above the array of ceiling tiles 12, connect the sprinkler head 34 or a plurality of such sprinkler heads to a source of fluid for completion of the sprinkler system 10. Preferably, the means 36 includes a rigid stationary water grid and supply 38 and a flexible hose 40 for each and every sprinkler head 34 mounted in the sprinkler system 10 for connecting the sprinkler head 34 to the water grid and supply 38. Preferably, the flexible hose 40 comprises an annealed stainless steel braid hose having an open pitch.

As known, the grid of rails 14 are secured in a conventional manner to the ceiling 32 and the walls 42 of the building or room, so as to be suspended at a predetermined distance from the ceiling 32.

The rigid stationary water grid and supply 38 comprises a plurality of interconnected pipes 44 rigidly supported from the ceiling 32 at a distance above the grid of rails 14 and connected to a sprinkler main 46. The sprinkler main 46 is, in turn, connected to a supply of fluid (water) under pressure (not shown). The plurality of interconnected pipes 44 range in diameter from about one inch to about 1 ¾ inches, with the sprinkler main 46 preferably being about 2 inches in diameter. The free end of the rigid stationary water grid and supply 38 preferably is capped by a two-inches bulk iron cap 48.

The plurality of pipes 44 can be formed of bulk iron, stainless steel, galvanized steel, fiberglass, and polyvinyl chloride (P.V.C.). A plurality of unions 50, preferably one-inch bulk iron unions, connect each of the plurality of the flexible hoses 40 to the pipes 44 of the rigid stationary water grid and supply 38. The size of the particular union 50 depends, of course, on the size of the particular segment of pipes 44, specifically its respective diameter at the point of connection with the flexible hose 40. Preferably any 90° connections, as shown at 52, between adjacent straight pipes 44, comprise a bulk iron segment of one and a half inches diameter. As known, pipes 44 nearest the 2" sprinkler main 46 feature the widest diameters, and pipes 44 progressively further away from the main 46 have progressively lesser diameters.

Figure 3:
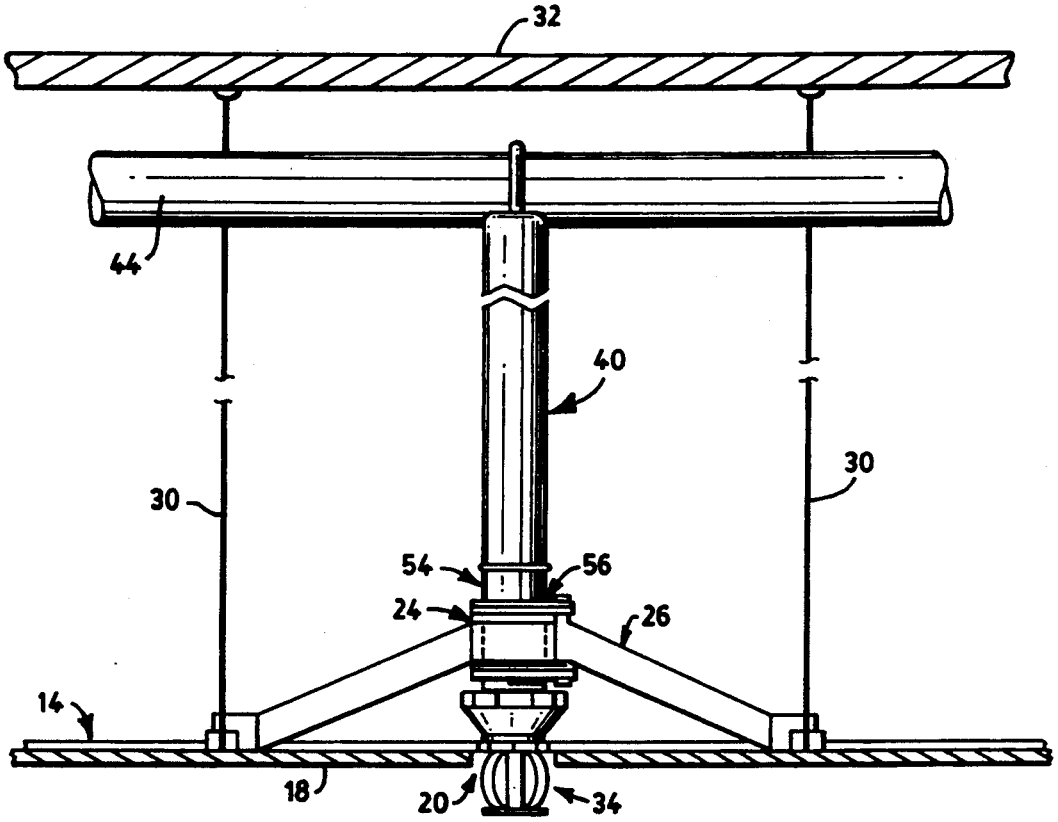
FIG. 3 is a schematic elevational view of the portion of the sprinkler system of FIG. 2.
Figure 4:
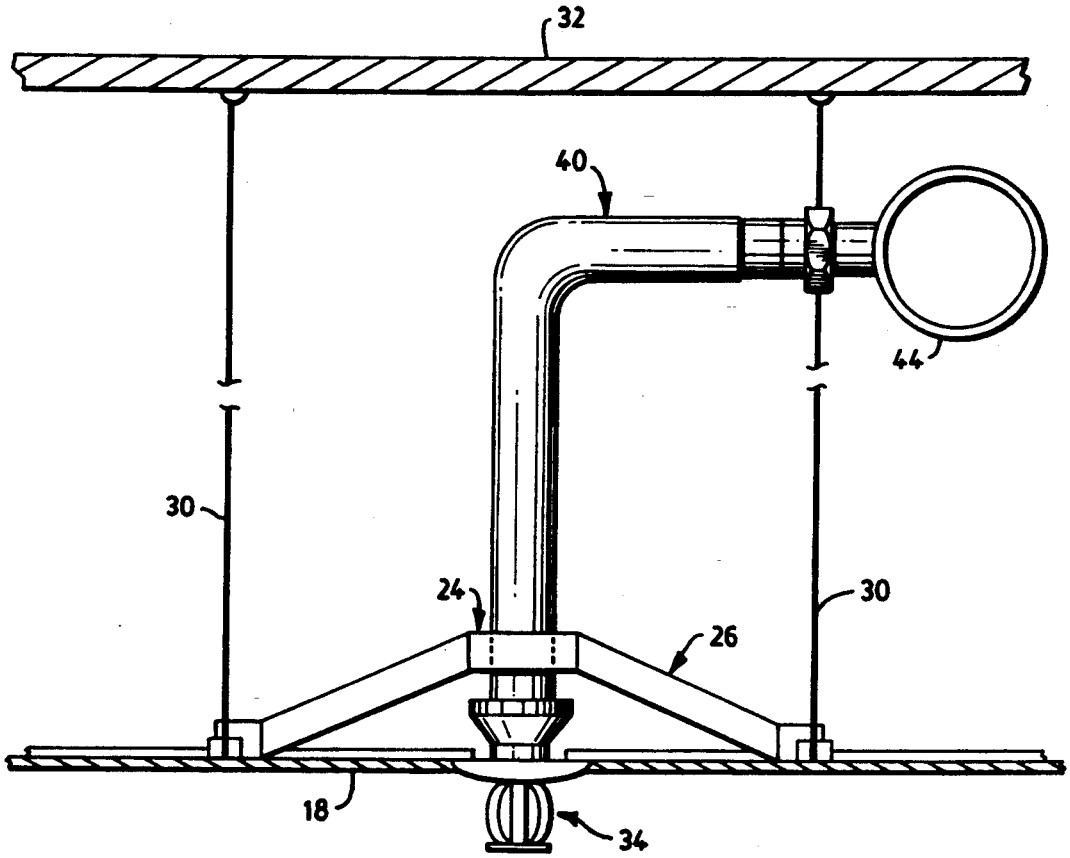
FIG. 4 is a schematic elevational view similar to FIG. 3 but showing the portion of the sprinkler system from its side.

Preferably, the means 36 for connecting each of the sprinkler heads 34 to a source of fluid also includes a carbon steel neck 54 connecting the flexible hose 40 to the sprinkler head 34; please observe FIG. 3. Preferably, the central hub 24 also is provided with a rubber-carbon steel clamp 56, having a pair of screw tighteners, to firmly secure the neck 54 within and to the central hub 24. Preferably, the central hub 24, the legs 26, and bar members 58 connecting the corners of each frame 28, all supporting both the tile 18 and the therethrough extending sprinkler head 34, are made of a suitable light-weight material, such as aluminum.

If desired, the flexible hose 40 also can be formed, in addition to stainless steel, from carbon steel with an open pitch.

Thus it has been shown and described an improved sprinkler system 10 for use in office buildings, warehouses, homes, and the like, which system 10 satisfies the objects and advantages set forth above.

Since certain changes may be made in the present disclosure without departing from the scope of the present invention, it is intended that all matter described in the foregoing specification or shown in the accompanying drawings, be interpreted in an illustrative and not in a limiting sense.

What is claimed is:

1. A sprinkler system for cooperation with an array of ceiling tiles supported on a grid of rails, said tiles being generally of like dimensional profile, said sprinkler system comprising:

(a) a mount of said tiles of like dimensional profile;

(b) said mount including a tile having a central opening;

(c) a web thereabove including a central hub and legs extending from said hub to corners of a frame of said like dimensional profile;

(d) a plurality of ceiling wires connected to said corners of said frame for supporting said frame in spaced relation to a ceiling;

(e) a sprinkler head supported within said central hub and extending through said central opening of said tile; and (f) means for connecting said sprinkler head to a source of fluid.

2. The sprinkler system of claim 1 wherein said means for connecting said sprinkler head to the source of fluid comprises a rigid stationary water grid and supply and a flexible hose connecting said sprinkler head to said rigid stationary water grid and supply.

3. The sprinkler system of claim 2 wherein said flexible hose comprises an annealed stainless steel braid hose having an open pitch.

4. The sprinkler system of claim 2 wherein said means further includes a carbon steel neck connecting said flexible hose to said sprinkler head.

5. The sprinkler system of claim 2 wherein said flexible hose has a length from about 24 inches to about 48 inches, and an internal diameter from about ½" to about one inch.

6. The sprinkler system of claim 1 wherein said web including said central hub and said legs are formed of aluminum.

7. A sprinkler system for cooperation with an array of ceiling tiles supported on a grid of rails, said tiles being generally of like dimensional profile, said sprinkler system comprising:

(a) a mount of said tiles of like dimensional profile;

(b) said mount including a plurality of tiles, each of which being provided with a central opening;

(c) a web including a plurality of frames of said like dimensional profile, each of said frames including a central hub and legs extending therefrom to corners of said frame thereof;

(d) a plurality of ceiling wires connected to said corners of each of said plurality of frames for supporting said frames in spaced relation to a ceiling;

(e) a plurality of sprinkler heads, with each of said heads supported within said central hub of each of said plurality of frames and extending through said central opening of said plurality of tiles; and (f) means for connecting said plurality of sprinkler heads to a source of fluid.

8. The sprinkler system of claim 7 wherein said means for connecting said plurality of sprinkler beads to the source of fluid comprises a rigid stationary water grid and supply and a plurality of flexible hoses connecting each of said sprinkler heads to said rigid stationary water grid and supply.

9. The sprinkler system of claim 8 wherein said plurality of flexible hoses comprise annealed stainless steel braid hoses, each formed with an open pitch.

10. The sprinkler system of claim 8 wherein said means further includes a plurality of carbon steel necks, each of said necks connecting each of said plurality of flexible hoses to each of said plurality of sprinkler heads.

11. The sprinkler system of claim 8 wherein the length of said plurality of flexible hoses varies from about 24 inches to about 48 inches, and wherein the internal diameter of each of said hoses varies from about ½" to about one inch.

12. The sprinkler system of claim 7 wherein said web including said central hubs and said legs are formed of aluminum.

* * * * *